US009194381B2

(12) United States Patent
Miyata et al.

(10) Patent No.: US 9,194,381 B2
(45) Date of Patent: Nov. 24, 2015

(54) BENT AXIS TYPE AXIAL PISTON PUMP/MOTOR

(75) Inventors: Takuya Miyata, Oyama (JP); Seita Hayashi, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/699,900

(22) PCT Filed: Jun. 8, 2012

(86) PCT No.: PCT/JP2012/064741

§ 371 (c)(1),
(2), (4) Date: Apr. 30, 2013

(87) PCT Pub. No.: WO2013/153684

PCT Pub. Date: Oct. 17, 2013

(65) Prior Publication Data

US 2015/0030471 A1 Jan. 29, 2015

(30) Foreign Application Priority Data

Apr. 13, 2012 (JP) ..... 2012-092286

(51) Int. Cl.
*F04B 1/24* (2006.01)
*F04B 1/20* (2006.01)

(52) U.S. Cl.
CPC ..... *F04B 1/2007* (2013.01); *F04B 1/2042* (2013.01); *F04B 1/24* (2013.01)

(58) Field of Classification Search
CPC ..... F01B 1/146; F01B 1/16; F01B 1/126; F01B 1/20; F01B 1/2035; F01B 1/2078; F01B 1/2071; F01B 1/2085; F01B 1/295; F01B 3/0035; F01B 3/007; F01B 3/0076; F01B 3/0079; F01B 3/02; F01B 3/0067; F01B 3/0073; F01B 3/106; F01B 3/109; F01B 3/0088
USPC ..... 417/269, 273; 91/489, 499, 505, 506
See application file for complete search history.

(56) References Cited

U.S. PATENT DOCUMENTS 3,073,254 A 1/1963 Hoover
3,198,131 A 8/1965 Thoma (Continued)

FOREIGN PATENT DOCUMENTS

DE 1904635 A1 10/1969
DE 2220847 A1 11/1972

(Continued)

OTHER PUBLICATIONS

International Search Report dated Aug. 21, 2012, issued for PCT/JP2012/064741.

(Continued)

*Primary Examiner* — Devon Kramer
*Assistant Examiner* — Patrick Hamo
(74) *Attorney, Agent, or Firm* — Locke Lord LLP

(57) ABSTRACT

A center shaft of a bent axis type axial piston pump/motor includes an outer race, which is attached to a shaft attachment hole of a cylinder block, has a shaft portion accommodation hole at one end and has a spring accommodation hole at the other end, and an inner shaft, which includes a shaft supporting spherical head portion having a large outer shape dimension at a distal end of a shaft base portion and attached to the shaft portion accommodation hole of the outer race through the shaft base portion.

1 Claim, 2 Drawing Sheets

(56) References Cited

U.S. PATENT DOCUMENTS

| | | | | |
|---|---|---|---|---|
| 3,208,395 | A | 9/1965 | Budzich | |
| 3,556,683 | A | 1/1971 | Schott et al. | |
| 3,661,055 | A | 5/1972 | Pruvot | |
| 3,827,337 | A | 8/1974 | Pruvot | |
| 4,576,554 | A * | 3/1986 | Wagenseil et al. | 417/270 |
| 6,279,452 | B1 | 8/2001 | Moya | |
| 2003/0136359 | A1 * | 7/2003 | Brosch et al. | 123/56.1 |
| 2004/0126245 | A1 * | 7/2004 | Folsom et al. | 417/269 |
| 2009/0013863 | A1 * | 1/2009 | Bianchi | 92/12.2 |
| 2009/0290996 | A1 * | 11/2009 | Ishizaki | 417/269 |

FOREIGN PATENT DOCUMENTS

| | | | |
|---|---|---|---|
| DE | 2029087 | B2 | 7/1974 |
| DE | 2262026 | A1 | 7/1974 |
| DE | 3043436 | A1 | 6/1981 |
| DE | 3340333 | C1 | 6/1985 |
| DE | 68912295 | T2 | 9/1994 |
| DE | 10030147 | C1 | 6/2002 |
| EP | 0377047 | A1 | 7/1990 |
| GB | 1301525 | A | 12/1972 |
| GB | 2064673 | A | 6/1981 |
| JP | 44-253 | Y1 | 1/1969 |
| JP | 47-46924 | B1 | 11/1972 |
| JP | 48-10722 | B1 | 4/1973 |
| JP | 52-36303 | A | 3/1977 |
| JP | 56-35568 | U | 4/1981 |
| JP | 56-038583 | A | 4/1981 |
| JP | 11-050952 | A | 2/1999 |
| JP | 3776585 | B2 | 5/2006 |
| JP | 2011-163260 | A | 8/2011 |

OTHER PUBLICATIONS

Office Action dated Sep. 24, 2014, issued for the corresponding German patent application No. 112012000086.2 and English translation thereof.

Minute of the Hearing dated Sep. 24, 2014, issued for the corresponding German patent application No. 112012000086.2 and English translation thereof.

Office Action dated Sep. 30, 2013, issued for the corresponding German patent application No. 112012000086.2 and English translation thereof.

* cited by examiner

BENT AXIS TYPE AXIAL PISTON PUMP/MOTOR

FIELD

The present invention relates to a bent axis type axial piston pump/motor.

BACKGROUND

In a bent axis type axial piston pump/motor, for example, a shaft center of a cylinder block is arranged in an inclined state with respect to a drive shaft, which is rotatably supported by a casing, as described in Patent Literature 1. A center shaft and a plurality of piston rods are arranged on one end face facing the drive shaft in the cylinder block. The center shaft is arranged at a position on the shaft center of the cylinder block, and the plurality of piston rods are arranged at equal intervals on a circumference having the center shaft as the center. A supporting end, which projects out from one end face of the cylinder block in the center shaft, and a supporting end, which projects out from one end face of the cylinder block in the piston rod, are each configured to have a spherical shape and are supported in a tiltable manner on one end face of the drive shaft.

A valve plate for rotatably supporting the cylinder block is brought into contact with the other end face of the cylinder block. The valve plate includes a high pressure port and a low pressure port, which are selectively connected to a cylinder bore according to the rotation position of the cylinder block.

In the bent axis type axial piston pump/motor configured as above, the piston rod moves a stroke in the cylinder bore according to the tilt angles of the drive shaft and the cylinder block when the drive shaft and the cylinder block are rotated around the shaft centers respectively. Therefore, for example, if oil is supplied to the high pressure port and the low pressure port is connected to an oil tank, the piston rods advance and move in turn in the cylinder bore connected to the high pressure port and the piston rods degenerate and move in turn in the cylinder bore connected to the low pressure port, so that the cylinder block is rotated and the desired rotation force is obtained through the drive shaft.

In this type of bent axis type axial piston pump/motor, a push spring is generally interposed between the center shaft and the cylinder block. The push spring prevents leakage caused when the oil passes between the high pressure port of the valve plate and the cylinder bore by pushing the other end face of the cylinder block against the valve plate. Therefore, the leakage of oil is reliably prevented by applying the push spring having a large attachment load. For instance, Patent Literature 1 describes applying the push spring having a large attachment load if a shaft portion of the center shaft is configured to have a thick diameter, thus reliably preventing the oil leakage from between the valve plate and the cylinder block to enhance the volume efficiency of the motor.

CITATION LIST

Patent Literature

Patent Literature 1: Japanese Patent Application Laid-open No. 2011-163260

SUMMARY

Technical Problem

The supporting end of the center shaft and the supporting end of the piston rod are preferably supported at the end face of the drive shaft by a retainer plate in order to ensure a smooth rotation of the cylinder block and the drive shaft. In other words, if the supporting end of the center shaft and the supporting end of the piston rod are supported at the end face of the drive shaft by the retainer plate, the movement in which the supporting end of the center shaft and the supporting end of the piston rod separate from the end face of the drive shaft can be inhibited, and for example, an event where the shaft center of the cylinder block shifts does not arise and the piston rod can reliably move a stroke.

However, the outer shape dimension of the supporting end needs to be larger than the shaft portion in the center shaft having the supporting end supported by the retainer plate. Therefore, if the shaft portion of the center shaft is configured to have a thick diameter to apply the push spring having a large attachment load, the outer shape dimension also needs to be formed large for the supporting end of the center shaft. As a result, an inner diameter of a shaft insertion hole formed in the retainer plate needs to be enlarged, which causes lowering in the strength of the retainer plate, and hence an event where the supporting end of the center shaft and the supporting end of the piston rod separate from the end face of the drive shaft may occur.

In view of such situations, it is an object of the present invention to provide a bent axis type axial piston pump/motor capable of more reliably preventing the oil leakage from between the valve plate and the cylinder block without arising an event where the supporting end of the center shaft and the supporting end of the piston rod separate from the end face of the drive shaft.

Solution to Problem

In order to achieve the purposes described above, there is provided a bent axis type axial piston pump/motor comprising: a cylinder block, which is arranged inside a casing, has a shaft attachment hole on a shaft center of one end face, and includes a plurality of cylinder bores on a circumference having the shaft center as a center; a plurality of piston rods, each of which are arranged in the cylinder bores of the cylinder block with a supporting end projecting out from the cylinder block; a center shaft, which has a base portion attached to the shaft attachment hole of the cylinder block and has a supporting end projecting out from the shaft attachment hole; a drive shaft rotatably supported by the casing with one end arranged inside the casing; a retainer plate for supporting the supporting end of the center shaft in a tiltable manner at a position to be on a shaft center at one end face of the drive shaft arranged inside the casing, and supporting the supporting end of the piston rod in a tiltable manner on a circumference having the shaft center as a center at one end face of the drive shaft; a valve plate, which is interposed between another end face of the cylinder block and the casing, rotatably supports the cylinder block at inside the casing, and carries out a switching control of pressure with respect to the plurality of cylinder bores according to a rotation position of the cylinder block; and a push spring, which is arranged in the shaft attachment hole of the cylinder block to act to push the cylinder block against the valve plate, the piston rod stroke moving in the cylinder bore according to tilt angles of the drive shaft and the cylinder block when the drive shaft and the cylinder block are rotated around the shaft centers respectively, wherein the center shaft includes, an outer race, which is attached to the shaft attachment hole of the cylinder block, includes a shaft portion accommodation hole at one end, and includes a spring accommodation hole at the other end, and an inner shaft, which includes a supporting portion having an outer shape dimension larger than the base portion at a distal end of the base portion having a shaft shape, and is attached to the shaft portion accommodation hole of the outer race through the base portion, and one end of the outer race is attached to the shaft attachment hole of the cylinder block with the push spring accommodated in the spring accommodation hole, and supported in a tiltable manner at an end face of the drive shaft by way of the supporting portion of the inner shaft.

Advantageous Effects of Invention

According to the present invention, the center shaft includes the outer race and the inner shaft, so that a push spring having a large attachment load can be applied without affecting the outer shape dimension of the supporting portion. Therefore, the event where the supporting end of the center shaft and the supporting end of the piston rod separate from the end face of the drive shaft can be prevented while ensuring the strength of the retainer plate, and furthermore, the attachment load of the push spring can be increased and the oil leakage from between the valve plate and the cylinder block can be more reliably prevented.

DESCRIPTION OF EMBODIMENTS

A preferred embodiment of a bent axis type axial piston pump/motor according to the present invention will be hereinafter described in detail with reference to the accompanying drawings.

Figure 1:
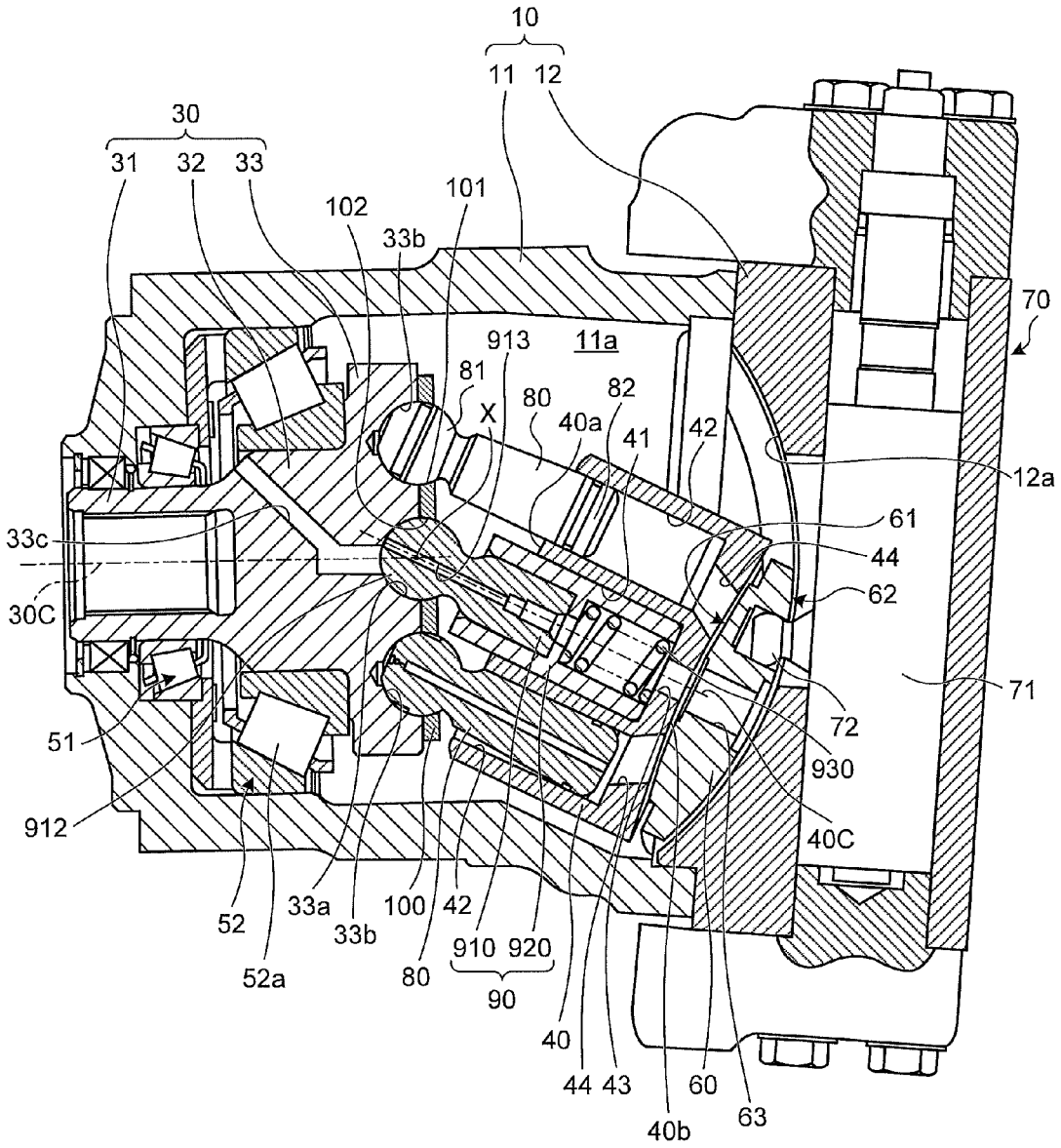
FIG. 1 is a cross-sectional view of a bent axis type axial piston pump/motor according to an embodiment of the present invention.

FIG. 1 illustrates a bent axis type axial piston motor according to an embodiment of the present invention. The bent axis type axial piston motor illustrated herein is used as a hydraulic motor for a vehicle used for a construction machine such as a wheel loader, and includes a casing 10. The casing 10 includes a casing main body 11, which has a hollow shape with one end opened, and a guide plate 12, which is attached to one end of the casing main body 11 while closing the opening of the casing main body 11, and accommodates a drive shaft 30 and a cylinder block 40 in a hollow interior 11*a* of the casing main body 11.

The drive shaft 30 has a second bearing supporting unit 32 of a thick diameter at one end of a first bearing supporting unit 31 having a circular column shape, and a disc unit 33 having a circular disc shape of a large diameter at one end of the second bearing supporting unit 32. The drive shaft 30 is supported by the casing main body 11 by way of the first bearing supporting unit 31 and the second bearing supporting unit 32 with the disc unit 33 positioned in the hollow interior 11*a* of the casing main body 11. More specifically, a first taper roller bearing 51 is arranged between the first bearing supporting unit 31 of the drive shaft 30 and the casing main body 11, a second taper roller bearing 52 is arranged between the second bearing supporting unit 32 of the drive shaft 30 and the casing main body 11, and the drive shaft 30 can be rotated about its shaft center 30C with respect to the casing main body 11. The second taper roller bearing 52 is formed larger than the first taper roller bearing 51, and is interposed between the drive shaft 30 and the casing main body 11 with a thick diameter portion of a taper roller 52*a* facing the hollow interior 11*a* of the casing main body 11.

A shaft supporting portion 33*a* and a plurality of rod supporting portions 33*b* are arranged at the end face of the disc unit 33 of the drive shaft 30. The shaft supporting portion 33*a* and the rod supporting portion 33*b* are each a substantially semi-spherical recess opened to the end face of the disc unit 33. The shaft supporting portion 33*a* is formed only at a position to be on the shaft center 30C of the drive shaft 30 in the disc unit 33. Although not clearly illustrated in the figure, the rod supporting portion 33*b* is arranged on a common circumference having the shaft center 30C of the drive shaft 30 as the center, and is arranged at seven positions at equal intervals with each other. An escape passage 33*c* is opened inside the shaft supporting portion 33*a*. The escape passage 33*c* is extended from the shaft supporting portion 33*a* along the shaft center 30C of the drive shaft 30, and then extended to gradually incline in an outer peripheral direction towards the other end side, and opened at an outer peripheral surface of the drive shaft 30 at between the first bearing supporting unit 31 and the second bearing supporting unit 32.

The cylinder block 40 is a columnar member having a circular cross-section in a radial direction, and includes a shaft attachment hole 41 and a plurality of cylinder bores 42. The shaft attachment hole 41 and the cylinder bores 42 are empty areas formed along a shaft center 40C of the cylinder block 40 respectively. The shaft attachment hole 41 and the cylinder bores 42 have cross-sections of a uniform circular shape in a radial direction, and are opened at one end face 40*a* of the cylinder block 40. The shaft attachment hole 41 is formed only at a position to be on the shaft center 40C of the cylinder block 40. Although not clearly illustrated in the figure, the cylinder bores 42 are arranged on a common circumference having the shaft center 40C of the cylinder block 40 as the center, and are arranged at seven positions at equal intervals with each other. The circumference of the cylinder bores 42 is set to the same dimension as the circumference of the rod supporting portions 33*b* in the disc unit 33 of the drive shaft 30.

In the cylinder block 40, the one end face 40*a*, to which the shaft attachment hole 41 and the cylinder bores 42 are opened, is formed to be a plane orthogonal to the shaft center 40C, and the other end face is formed to be a recessed surface 40*b*. Although not clearly illustrated in the figure, the recessed surface 40*b* of the cylinder block 40 is formed to be a sphere having a center on the extension of the shaft center 40C of the cylinder block 40. A communication hole 43 and a plurality of access passages 44 are opened at the recessed surface 40*b* of the cylinder block 40. The communication hole 43 is an opening provided only at a position to be on the shaft center 40C of the cylinder block 40, and is communicated with the shaft attachment hole 41. An inner diameter of the communication hole 43 is formed to be smaller than an inner diameter of the shaft attachment hole 41. Although not clearly illustrated in the figure, the access passage 44 is an opening provided on a circumference having the shaft center 40C of the cylinder block 40 as the center, and is arranged at seven positions at equal intervals with each other. The circumference of the access passages 44 is set smaller than the circumference of the cylinder bores 42 in radius. Each access passage 44 is formed with an inner diameter smaller than that of the cylinder bore 42, and is communicated with the individual cylinder bore 42.

A valve plate 60 is arranged between the recessed surface 40*b* of the cylinder block 40 and the guide plate 12 of the casing 10. The valve plate 60 includes a slidably moving projecting spherical surface 61 and a slidably moving projecting tubular surface 62, and makes contact with the recessed surface 40*b* of the cylinder block 40 in a slidably moving manner through the slidably moving projecting spherical surface 61 and makes contact with a guide surface 12*a* of the guide plate 12 in a slidably moving manner through the slidably moving projecting tubular surface 62. The slidably moving projecting spherical surface 61 is a portion that projects out in a spherical shape having the same curvature radius as the recessed surface 40*b* of the cylinder block 40, and can slidably move in a state closely adhered over the entire surface with respect to the recessed surface 40*b* of the cylinder block 40. The slidably moving projecting tubular surface 62 is a convex cylindrical surface projecting out towards the opposite side of the slidably moving projecting spherical surface 61.

The guide surface 12*a* of the guide plate 12, with which the slidably moving projecting tubular surface 62 makes contact, is a concave cylindrical surface having the same curvature radius as the slidably moving projecting tubular surface 62 and having an arc length larger than the slidably moving projecting tubular surface 62, and is formed at a portion facing the disc unit 33 of the drive shaft 30. The guide surface 12*a* of the guide plate 12 has the position set so that a line that includes a center point X of the shaft supporting portion 33*a* arranged in the disc unit 33 of the drive shaft 30 and that is orthogonal to the shaft center 30C of the drive shaft 30 becomes a center axis of the cylinder.

A reference numeral 70 in the figure is an actuator for moving the valve plate 60 along the guide surface 12*a* of the guide plate 12. In the actuator 70, an actuator piston 71, which is an output object, engages the valve plate 60 in a tiltable manner through a linkage pin 72.

Although not clearly illustrated in the figure, a high pressure port and a low pressure port are opened at portions corresponding to the access passages 44 of the cylinder block 40 in the slidably moving projecting spherical surface 61 of the valve plate 60. The high pressure port and the low pressure port are arranged such that the high pressure port communicates with the plurality of cylinder bores 42 positioned on one side and the low pressure port communicates with the plurality of cylinder bores 42 positioned on the other side when the cylinder block 40 is divided in half with a virtual plane including the shaft center 40C of the cylinder block 40 and the shaft center 30C of the drive shaft 30, for example. A reference numeral 63 in the figure is a communication path formed at a portion from the slidably moving projecting spherical surface 61 to the slidably moving projecting tubular surface 62 of the valve plate 60. The communication path 63 is opened to the slidably moving projecting spherical surface 61 at the portion facing the shaft center 40C of the cylinder block 40.

The cylinder block 40 has a piston rod 80 arranged in each cylinder bore 42, and a center shaft 90 arranged in the shaft attachment hole 41. The piston rod 80 has a tapered shape in which the outer diameter gradually increases from the basal end towards the distal end, where a supporting spherical head portion (supporting end) 81 is arranged at the basal end and a piston portion 82 is arranged at the distal end so as to be inserted to the cylinder bore 42 in a slidably moving manner through the piston portion 82. The supporting spherical head portion 81 of the piston rod 80 has a spherical shape having an outer diameter that enables the insertion to the rod supporting portion 33*b* formed in the disc unit 33 of the drive shaft 30 in a slidably moving manner. The supporting spherical head portion 81 of the piston rod 80 is configured to have an outer diameter larger than the outer diameter of the piston portion 82.

Figure 2:
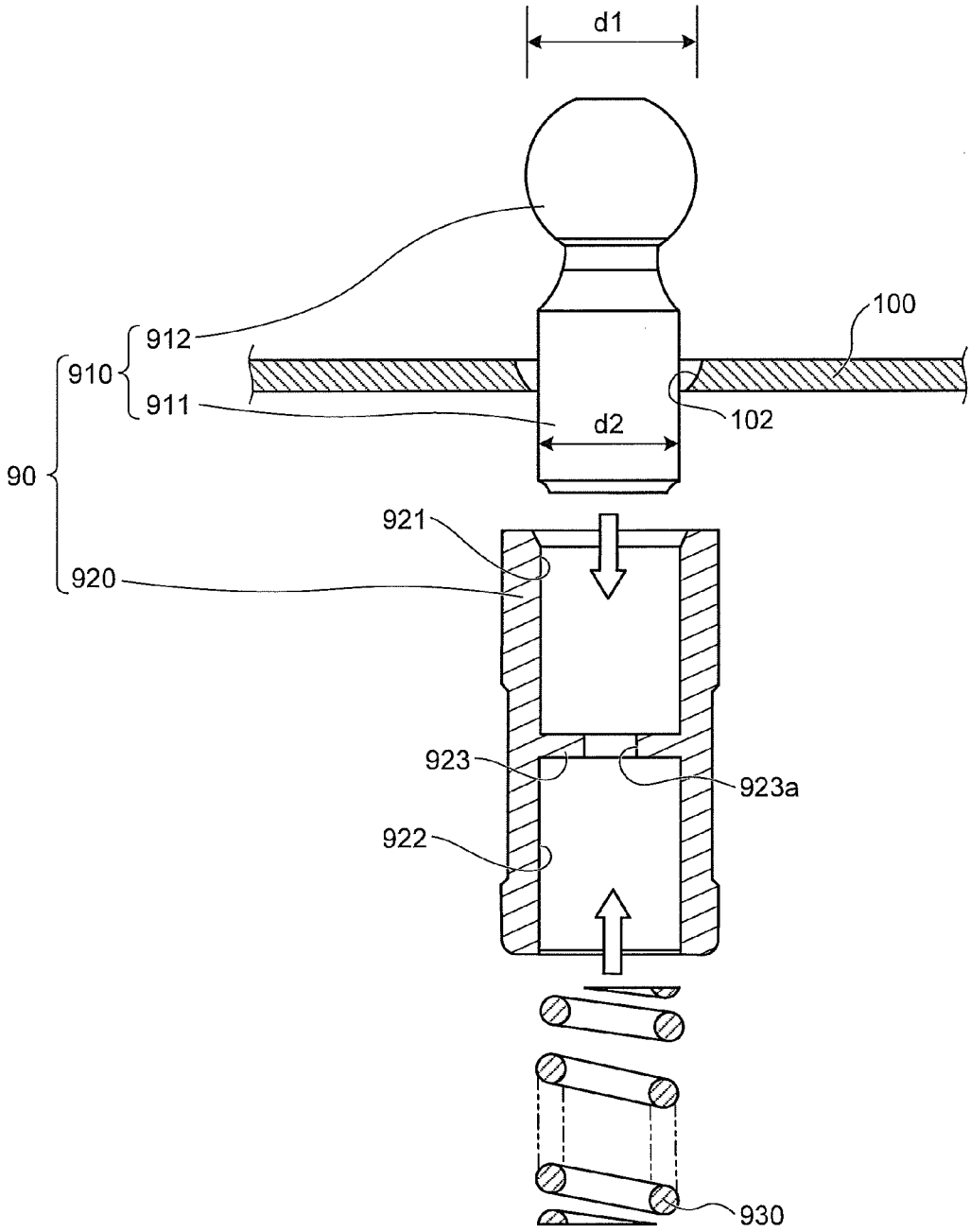
FIG. 2 is a cross-sectional view illustrating, in an exploded manner, a center shaft applied to the bent axis type axial piston pump/motor illustrated in FIG. 1.

The center shaft 90 is attached to the shaft attachment hole 41 of the cylinder block 40, and includes an inner shaft 910 and an outer race 920, as illustrated in FIG. 2. The inner shaft 910 includes a shaft base portion (base portion) 911 having a circular column shape, and a shaft supporting spherical head portion (supporting portion) 912 arranged at the basal end of the shaft base portion 911. The shaft supporting spherical head portion 912 of the inner shaft 910 has a spherical shape having an outer diameter d1 that enables the insertion to the shaft supporting portion 33*a* formed in the disc unit 33 of the drive shaft 30 in a slidably moving manner. The shaft base portion 911 is formed such that an outer diameter d2 is smaller than the outer diameter d1 of the shaft supporting spherical head portion 912. As illustrated in FIG. 1, an oil passage 913 is arranged inside the inner shaft 910 from an end face of the shaft base portion 911 to a top portion of the shaft supporting spherical head portion 912. The oil passage 913 is provided to guide the oil to the escape passage 33*c* formed in the drive shaft 30 when the oil enters the shaft attachment hole 41 through the communication path 63 of the valve plate 60 and the communication hole 43 of the cylinder block 40.

The outer race 920 has a circular column shape having an outer diameter that enables attachment to the shaft attachment hole 41 of the cylinder block 40 without rattling. As illustrated in FIG. 1, the length along the axial direction of the outer race 920 is longer than the shaft attachment hole 41 so that one part projects outside when attached to the shaft attachment hole 41. As illustrated in FIG. 2, the outer race 920 includes a shaft portion accommodation hole 921 and a spring accommodation hole 922 at portions to be on the shaft center. The shaft portion accommodation hole 921 is an empty area that opens to one end face of the outer race 920, and has a circular cross-section in the radial direction. The inner diameter of the shaft portion accommodation hole 921 is formed with a dimension enabling the shaft base portion 911 of the inner shaft 910 to be attached without rattling. The spring accommodation hole 922 is an empty area that opens to the other end face of the outer race 920. The spring accommodation hole 922 has a circular cross-section in a radial direction, and interiorly accommodates a push spring 930. The push spring 930 is a coil spring configured such that the outer diameter is slightly smaller than the inner diameter of the spring accommodation hole 922 and the entire length in a no-load state is longer than the spring accommodation hole 922. A partition wall 923 is interposed between the shaft portion accommodation hole 921 and the spring accommodation hole 922. The partition wall 923 is a circular disc shaped portion having a through-hole 923*a* of a thin diameter at the center part, and has a function of partitioning the shaft portion accommodation hole 921 and the spring accommodation hole 922 and being a spring receiver for the push spring 930.

As illustrated in FIG. 1, a plurality of piston rods 80 and the center shaft 90 are supported in a tiltable manner with respect to the end face of the disc unit 33 with the separation movement of each spherical head portion 81, 912 from the end face of the disc unit 33 regulated by attaching the respective spherical head portions 81, 912 to the rod supporting portion 33*b* or the shaft supporting portion 33*a* formed in the disc unit 33 of the drive shaft 30, and then fixing a retainer plate 100 to the end face of the disc unit 33. The retainer plate 100 is a plate-shaped member that includes a rod insertion hole 101 at a portion facing the rod supporting portion 33*b* of the disc unit 33, and includes a shaft insertion hole 102 at a portion facing the shaft supporting portion 33*a*. The rod insertion hole 101 is formed with an inner diameter smaller than the supporting spherical head portion 81 of the piston rod 80, and the shaft insertion hole 102 is formed with an inner diameter smaller than the shaft supporting spherical head portion 912 of the center shaft 90. The retainer plate 100 is attached to the end face of the disc unit 33 with each piston rod 80 inserted to the rod insertion hole 101 and the center shaft 90 inserted to the shaft insertion hole 102 in advance.

In the bent axis type axial piston motor configured as above, the drive shaft 30 and the cylinder block 40 are linked to each other with the respective shaft centers 30C, 40C intersecting by the center shaft 90 and the plurality of piston rods 80 interposed between the disc unit 33 of the drive shaft 30 and the cylinder block 40.

If the oil is supplied to the high pressure port and the low pressure port is connected to an oil tank (not illustrated) from this state, the piston rods 80 advance and move in turn toward the drive shaft 30 in the cylinder bore 42 connected to the high pressure port, and the piston rods 80 retract and move in turn in the cylinder bore 42 connected to the low pressure port, so that the cylinder block 40 is rotated and functions as the bent axis type axial piston motor having the drive shaft 30 as the output shaft. If the actuator 70 is driven to change the position of the valve plate 60 with respect to the guide surface 12*a* of the guide plate 12, the tilt angle of the cylinder block 40 with respect to the drive shaft 30 is changed and it is operated in a state the stroke movement amount, that is, the volume of the piston rod 80 with respect to the cylinder bore 42 is changed.

If the rotation is stopped with the pressure held at the high pressure port, the recessed surface 40*b* of the cylinder block 40 and the slidably moving projecting spherical surface 61 of the valve plate 60 are always pushed by the push spring 930 interposed between the outer race 920 of the center shaft 90 and the cylinder block 40. Therefore, when the gap between the cylinder block 40 and the valve plate 60 is closely attached, the amount of oil that leaks from therebetween can be made extremely small. During the rotating operation, the recessed surface 40*b* of the cylinder block 40 and the slidably moving projecting spherical surface 61 of the valve plate 60 are always pushed by the push spring 930 interposed between the outer race 920 of the center shaft 90 and the cylinder block 40. Therefore, the oil that passes the high pressure port makes the oil film thickness of the slidably moving portion between the cylinder block 40 and the valve plate 60 thin, thus preventing the leakage of oil from the gap and enhancing the volume efficiency.

According to the bent axis type axial piston motor, the shaft supporting spherical head portion 912 of the center shaft 90 and the supporting spherical head portion 81 of the piston rod 80 are supported by the disc unit 33 of the drive shaft 30 by the retainer plate 100. Therefore, the movement in which the shaft supporting spherical head portion 912 of the center shaft 90 and the supporting spherical head portion 81 of the piston rod 80 separate from the end face of the disc unit 33 can be inhibited, and for example, an event where the shaft center 40C of the cylinder block 40 shifts does not arise, whereby the smooth rotation of the cylinder block 40 and the drive shaft 30 can be ensured and the piston rod 80 can reliably be moved in a stroking manner.

Furthermore, since the center shaft 90 has the outer race 920 and the inner shaft 910 separately configured, the outer diameter dimension of the shaft supporting spherical head portion 912 will not be affected even if the push spring 930 having a large attachment load is applied. In other words, when applying the push spring 930 of large outer shape dimension to more reliably prevent the oil leakage from between the cylinder block 40 and the valve plate 60, the outer diameter dimension of the outer race 920 merely needs to be enlarged to form a large spring accommodation hole 922 and the shaft base portion 911 of the inner shaft 910 does not need to be formed in a thick diameter. Therefore, the outer diameter dimension of the shaft supporting spherical head portion 912 also does not need to be formed large and the inner diameter of the shaft insertion hole 102 of the retainer plate 100 also does not need to be enlarged, so that sufficient strength can be ensured in the retainer plate 100. Therefore, the event where the shaft supporting spherical head portion 912 of the center shaft 90 and the supporting spherical head portion 81 of the piston rod 80 separate from the disc unit 33 of the drive shaft 30 is reliably prevented.

In the embodiment described above, the bent axis type axial piston motor is illustrated, but application can also be made to the bent axis type axial piston pump. Furthermore, that in which the tilt angle of the cylinder block 40 can be changed with respect to the drive shaft 30 is illustrated, but the present invention is not necessarily limited to that in which the tilt angle can be changed, and can be applied to a fixed volume type in which the tilt angle does not change.

Furthermore, in the embodiment described above, the shaft portion accommodation hole 921 and the spring accommodation hole 922 of the outer race 920 are formed to have substantially the same inner diameter, but the inner diameter of the spring accommodation hole 922 may, of course, be enlarged irrespective of the inner diameter of the shaft portion accommodation hole 921. In this case, the push spring having a larger attachment load can be applied by applying the outer race 920 having a larger outer diameter.

REFERENCE SIGNS LIST

10 Casing
30 Drive Shaft
40 Cylinder Block
40*a* One End Face
41 Shaft Attachment Hole
42 Cylinder Bore
60 Valve Plate
80 Piston Rod
81 Supporting Spherical Head Portion
90 Center Shaft
100 Retainer Plate
910 Inner Shaft
911 Shaft Base Portion
912 Shaft Supporting Spherical Head Portion
920 Outer Race
921 Shaft Portion Accommodation Hole
922 Spring Accommodation Hole
930 Push Spring

The invention claimed is:

1. A bent axis type axial piston pump/motor comprising:

a cylinder block, which is arranged inside a casing, having a shaft attachment hole of the cylinder block on a shaft center of the cylinder block at one end face of the cylinder block, and including a plurality of cylinder bores on a circumference having the shaft center of the cylinder block as a center;

a plurality of piston rods, each of the plurality of piston rods are arranged in a respective one of the plurality of cylinder bores of the cylinder block with a supporting end projecting out from the cylinder block;

a center shaft, which has a base portion attached to the shaft attachment hole of the cylinder block and has a supporting end of the center shaft projecting out from the shaft attachment hole;

a drive shaft rotatably supported by the casing with one end arranged inside the casing;

a retainer plate for supporting the supporting end of the center shaft in a tiltable manner at a position to be on a shaft center of the drive shaft at one end face of the drive shaft arranged inside the casing, and supporting the supporting end of each of the piston rods in a tiltable manner on a circumference having the shaft center of the drive shaft as a center at the one end face of the drive shaft;

a valve plate, which is interposed between another end face of the cylinder block and the casing, rotatably supporting the cylinder block inside the casing, and carrying out a switching control of pressure with respect to the plurality of cylinder bores according to a rotation position of the cylinder block; and a push spring, which is arranged in the shaft attachment hole of the cylinder block to act to push the cylinder block against the valve plate, wherein each of the piston rods strokes in each of the cylinder bores according to tilt angles of the drive shaft and the cylinder block when the drive shaft and the cylinder block are rotated around the shaft centers of the cylinder block and the drive shaft respectively, and wherein the center shaft includes, an outer race, which is attached to the shaft attachment hole of the cylinder block, includes a shaft portion accommodation hole at a first end, and includes a spring accommodation hole at a second end opposite the first end, an inner shaft, which includes a supporting portion having an outer shape dimension larger than the base portion at a distal end of the base portion having a shaft shape, and is attached to the shaft portion accommodation hole of the outer race through the base portion, and the first end of the outer race is attached to the shaft attachment hole of the cylinder block with the push spring accommodated in the spring accommodation hole, and supported in a tiltable manner at the one end face of the drive shaft by way of the supporting portion of the inner shaft.

* * * * *